United States Patent [19]

Tano et al.

[11] Patent Number: 4,570,388

[45] Date of Patent: Feb. 18, 1986

[54] APPARATUS FOR ABRASIVE CLEANING

[75] Inventors: Hiroshi Tano; Masanobu Takahashi, both of Maizuru; Minoru Shiraishi; Yoshimi Numata, both of Kumamoto; Norio Urata, Arao; Tatsuo Kawano, Kumamoto; Tatsumi Onaka, Amagasaki, all of Japan

[73] Assignee: Hitachi Zosen Corporation, Osaka, Japan

[21] Appl. No.: 569,312

[22] Filed: Jan. 9, 1984

[51] Int. Cl.[3] ..... B24B 7/10; B63B 59/10

[52] U.S. Cl. ..... 51/177; 51/170 T; 51/180; 114/222; 180/274; 173/2

[58] Field of Search ..... 51/177, 170 T, 174, 51/180; 15/1.7, 49 R, 49 RB, 50 R, 98; 180/274, 275, 277; 173/2, 5, 27; 114/222, 150

[56] References Cited

U.S. PATENT DOCUMENTS

| | | | |
|---|---|---|---|
| 487,198 | 11/1892 | McCutchan | 51/177 |
| 864,403 | 8/1907 | Beck | 51/177 |
| 1,100,316 | 6/1914 | Masterson | 293/5 |
| 3,110,140 | 11/1963 | Reames | 51/379 |
| 3,496,681 | 2/1970 | Oswald | 15/49 R |
| 3,946,692 | 3/1976 | Sierra et al. | 15/49 R |
| 4,365,573 | 12/1982 | Jamieson | 114/150 |
| 4,445,451 | 5/1984 | van den Broek | 114/222 |

FOREIGN PATENT DOCUMENTS

| | | | |
|---|---|---|---|
| 501105 | 11/1954 | Italy | 51/170 T |
| 533284 | 9/1955 | Italy | 51/177 |
| 58-15653 | 1/1983 | Japan . | |
| 58-59555 | 4/1983 | Japan . | |
| 77226 | 12/1917 | Switzerland | 51/177 |

*Primary Examiner*—Roscoe V. Parker

*Attorney, Agent, or Firm*—John W. Farley

[57] ABSTRACT

An apparatus for abrasive cleaning comprising a truck adapted to run on the surface to be cleaned and at least one abrasive cleaner supported by a supporting mechanism on the truck and limitedly movable toward or away from the surface, the abrasive cleaner having an abrasive cleaning tool at its lower end, said or each abrasive cleaner being supported by the supporting mechanism so as to be limitedly tiltable in every direction with respect to an axis approximately perpendicular to the surface, the supporting mechanism being provided with a compression spring for biasing the abrasive cleaner away from the surface. Even when the surface to be cleaned has an undulation, the abrasive cleaner tilts with respect to the axis to hold the cleaning tool in uniform contact with the surface and assure a stable and uniform cleaning operation. Since the force acting on the cleaning surface of the tool is not greater than the gravity on the cleaner, the cleaner can easily pass over projections on the surface to be cleaned without entailing the likelihood of causing excessive abrasion.

10 Claims, 9 Drawing Figures

APPARATUS FOR ABRASIVE CLEANING

The present invention relates to an apparatus for abrasive cleaning, and more particularly to a self-running abrasive cleaning apparatus for automatically removing soils or like deposits from the entire area of steel plate bottom surfaces or floor surfaces of ships.

An abrasive cleaning apparatus of this type is disclosed, for example, in Published Unexamined Japanese patent application No. 58-15653. The disclosed apparatus comprises a truck adapted to run on the surface to be cleaned and three abrasive cleaners mounted on the truck by support means and each having an abrasive cleaning tool at its lower end. The support means are provided with a movable frame which is limitedly movable toward or away from the surface along four guide rods projecting from the truck. The abrasive cleaners are fixed to the movable frame. The movable frame is biased at all times toward the surface to be cleaned by compression springs provided on the guide rods, with the result that the force acting on the cleaning surfaces of the abrasive tools corresponds to the biasing force of the compression springs plus the gravity on the movable frame and on the abrasive cleaners.

With the abrasive cleaning apparatus of the construction described above, the abrasive cleaner is movable only perpendicular to the surface to be cleaned (work surface), so that when the work surface has an undulation, the pressure of contact between the abrasive cleaning tool and the work surface increases locally to result in uneven cleaning or make the truck run unstably. While the abrasive cleaner is rendered movable perpendicular to the work surface to enable the cleaner to pass over projections on the work surface, the large force acting on the cleaning surface of the cleaning tool mentioned above entails the likelihood that the abrasive cleaner will be unable to pass over projections as intended if they are large. Further the cleaning surface of the abrasive cleaning tool, if subjected to a great force, is likely to remove not only the soil on the work surface but also the primary coat on the surface unexpectedly, consequently causing trouble to the subsequent operation of applying a finishing coat (secondary coat) to the surface.

In view of the above drawbacks of the conventional apparatus, an object of the present invention is to provide an abrasive cleaning apparatus which is operable stably to clean a surface uniformly as desired even when the surface has an undulation or projections.

To fulfill the object, the present invention provides an apparatus for abrasive cleaning comprising a truck adapted to run on the surface to be cleaned and at least one abrasive cleaner supported by supporting means on the truck and limitedly movable toward or away from the surface, the abrasive cleaner having an abrasive cleaning tool at its lower end, said or each abrasive cleaner being supported by the supporting means so as to be limitedly tiltable in every direction with respect to an axis approximately perpendicular to the surface, the supporting means being provided with resilient means for biasing the abrasive cleaner away from the surface.

With the abrasive cleaning apparatus of the foregoing apparatus, the abrasive cleaner is tiltable in every direction with respect to an axis perpendicular to the surface to be cleaned (work surface), so that even if the work surface has an undulation, the abrasive cleaner tilts with respect to the axis so as to hold the cleaning surface of the abrasive cleaning tool in uniform contact with the work surface. This permits the truck to run stably at all times and assures cleaning free of irregularities. Further because the resilient means included in the supporting means biases the abrasive cleaner away from the work surface, the force acting on the cleaning surface of the abrasive cleaning tool can be made not greater than the gravity acting on the abrasive cleaner, with the result that the abrasive cleaner can easily pass over projections on the work surface and is able to reliably remove soils only from the work surface as desired.

Various features and advantanges of the present invention will be readily understood from the embodiment to be described below with reference to the accompanying drawings, in which.

Figure 1:
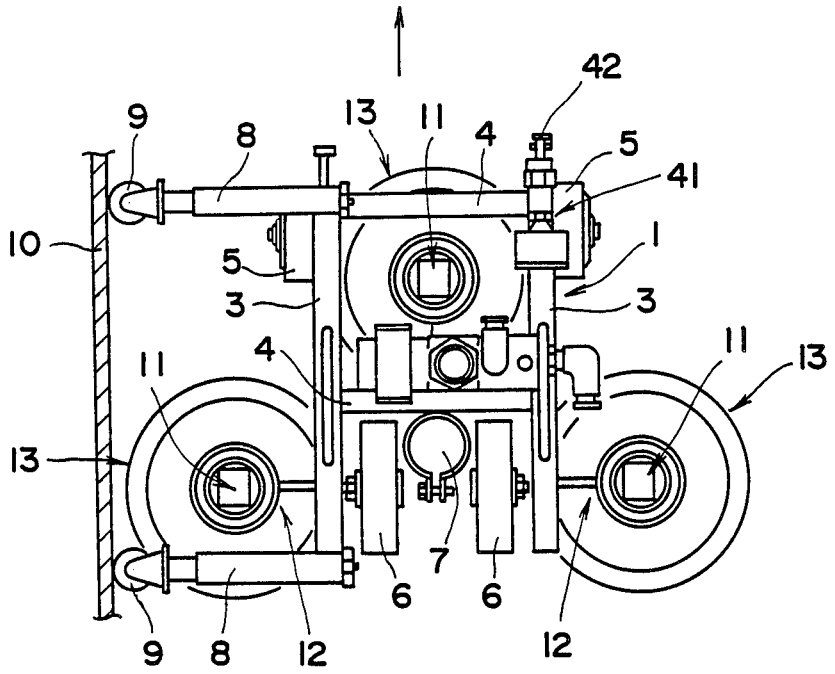
FIG. 1 is a plan view showing an abrasive cleaning apparatus embodying the invention.
Figure 2:
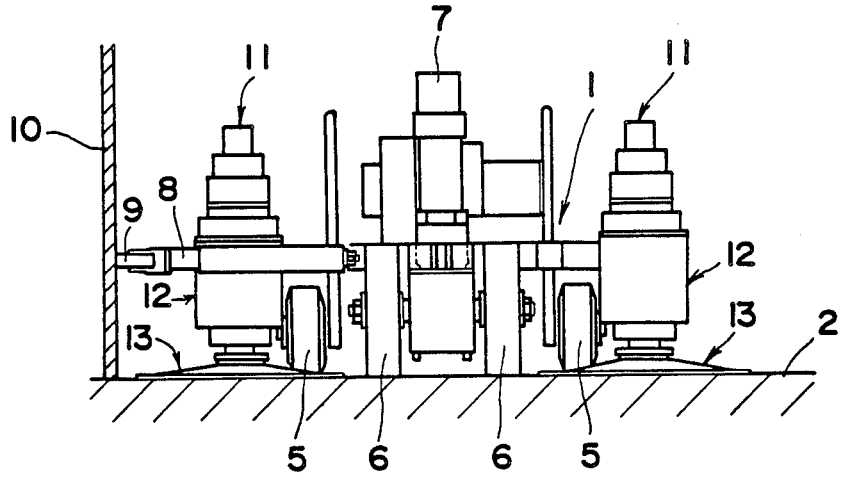
FIG. 2 is a rear view of the same apparatus.

With reference to FIGS. 1 and 2, indicated at 1 is a truck adapted to run on the floor surface 2 of a ship as an example of the surface to be cleaned by abrasion. The truck 1 comprises a frame including a pair of longitudinal beams 3 and a pair of lateral beams 4, and a pair of front wheels 5 and a pair of rear wheels 6 which are mounted on front portions and rear portions, respectively, of the frame. The rear wheels 6 are driven by a drive motor 7. A pair of telescopic arms 8 adjustable in length extends in parallel with the floor surface 2 from one of the longitudinal beams 3 of the truck 1. A roller 9 rotatably mounted on the forward end of each telescopic arm 8 bears against a longitudinal member 10 (as an example of guide surface) of the ship to thereby enable the truck 1 to run on the floor 2 along the longitudinal member 10. Three abrasive cleaners 11 are mounted in a triangular arrangement on the truck 1 by supporting means 12. An abrasive cleaning tool 13 is attached to the lower end of each abrasive cleaner 11.

Figure 3:
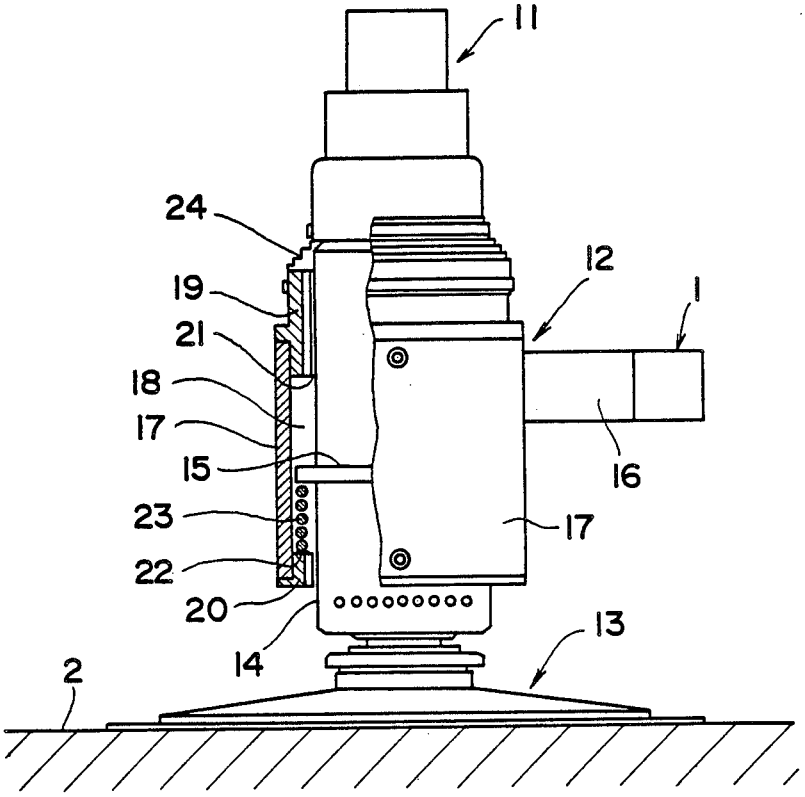
FIG. 3 is an enlarged front view partly broken away and showing supporting means for an abrasive cleaner of the apparatus.
Figure 4:
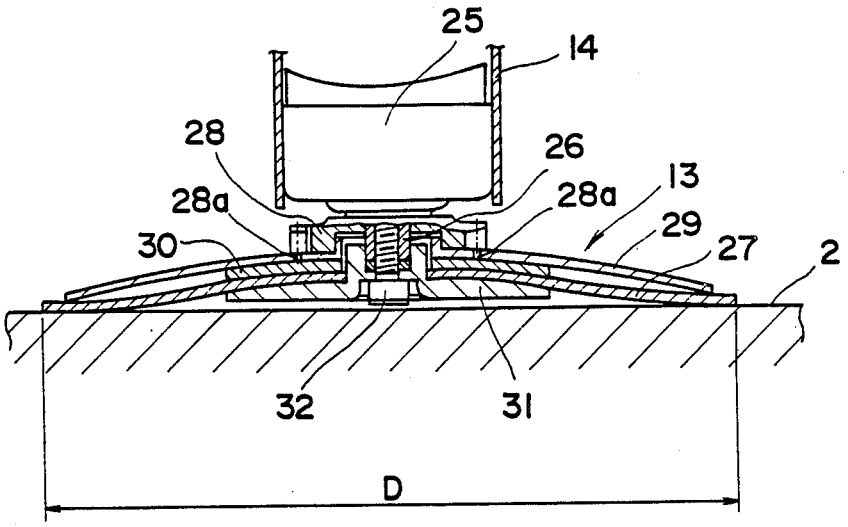
FIG. 4 is an enlarged front view partly in section and showing an abrasive cleaning tool of the apparatus.

As shown in FIG. 3, the abrasive cleaner 11 comprises a main body 14 having an approximately cylindrical outer surface, and an annular flange 15 is attached to the outer surface of the main body 14. Each supporting means 12 chiefly comprises a holding arm 16 fixed at its one end to the truck 1, and a holding cylinder 17 fixed to the other end of the arm 16 and surrounding the cleaner main body 14 with a first gap 18 formed therebetween. An upper ring 19 and a lower ring 20 are removably attached to the upper and lower ends, respectively, of the holding cylinder 17. A second gap 21 smaller than the first gap 18 is formed between the cleaner main body 14 and the rings 19, 20. A replaceable spacer 22 is provided on the lower ring 20. A compression spring 23 is interposed between the spacer 22 and the annular flange 15. Dustproof bellows 24 are provided between the upper ring 19 and the cleaner main body 14.

Because the supporting means 12 has the foregoing construction, the abrasive cleaner 11 is limitedly movable in directions along an axis perpendicular to the floor 2 and is also tiltable limitedly with respect to the perpendicular axis. Further because the compression spring 23 biases the abrasive cleaner 11 upward, the force acting on the cleaning surface of the abrasive cleaning tool 13 is not greater than the gravity acting on the cleaner 11 (which usually weighs about 1.5 kg). Accordingly even when the floor surface 2 has an undulation, the cleaner tilts to hold the cleaning tool 13 in uniform contact with the floor surface 2 at all times and will not produce cleaning irregularities. When there is a projection on the floor 2, the cleaner 11 moves up, permitting the cleaning tool 13 to pass over the projection easily. The cleaner 11 is further free of the likelihood that the force acting on the tool 13, if too great, will cause excessive abrasion, and can therefore remove soils only from the floor surface 2.

Preferably the spring constant of the compression spring 23 and the thickness of the spacer 22 are so determined that the force acting on the cleaning surface of the abrasive cleaning tool 13 is usually of a magnitude of about 1 kg. If the second gap 21 is excessively large, the outer periphery of the tool 13 will engage in the floor surface 2 to result in an unstable cleaning operation, whereas if it is too small, the tool 13 will be unable to follow the possible undulation of the floor surface 2. According to test results, the second gap 21 for an abrasive cleaning tool having a diameter of 18 cm should suitably be such that a clearance of up to about 1 to about 2 mm will be formed between the tool and the floor surface 2 when the abrasive cleaner 11 is tilted to the greatest possible extent. It is possible to provide a second compression spring (not shown) having a very small spring constant between the annular flange 15 and the upper ring 19, whereby the abrasive cleaner 11 is made supportable by the supporting means with improved stability.

The abrasive cleaning tool 13 is attached to the drive shaft 26 of a pneumatic drive motor 25 housed in the lower end of the cleaner main body 14 and has a disk sander 27. A mount 28 having projections **28*a* is fixed to the drive shaft 26. A dish-like rigid pad 29 is attached to the mount 28 with the projections 28*a* engaged in holes formed in the pad 29. An annular washer 30 is interposed between the central portion of the rigid pad 29 and the central portion of the disk sander 27. The central portion of the disk sander 27 is held in pressing contact with the washer 30 by a fastening member 31 which is fixed to the drive shaft 26 by a lock screw 32 screwed in the shaft 26. The rigid pad 29 is slightly smaller than the disk sander 27 in diameter, whereby the rigid pad 29 is adapted to hold the disk sander 27 in contact with the floor surface 2** only at the outer peripheral portion of the sander.

Figure 5:
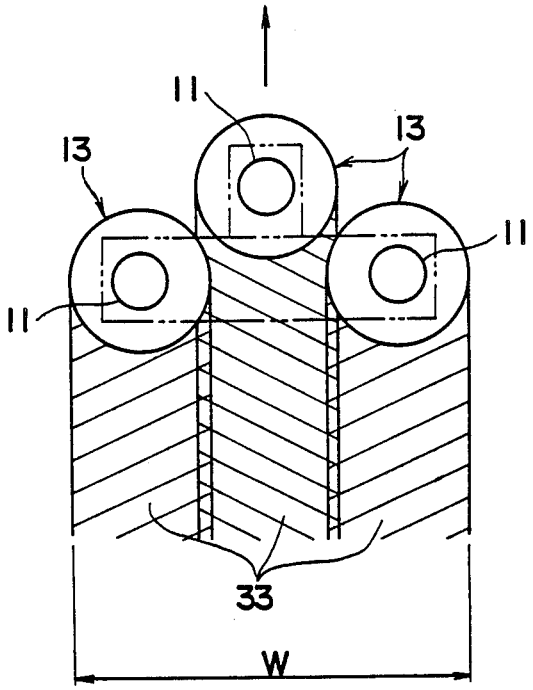
FIG. 5 is a schematic plan view showing the traces of the abrasive cleaning tools of the apparatus.

Because the outer peripheral portion of the disk sander 27 is held in contact with the floor surface 3 as stated above, the width of abrasive cleaning by the tool 13 in rotation corresponds to the diameter D of the disk sander 27. When the three abrasive cleaning tools 13 are in a triangular arrangement as already described, the overall width W of cleaning is as large as about three times the diameter of the disk sander 27 even if the traces 33 of the tools 13 are somewhat in overlapping relation as seen in FIG. 5.

The rigid pad 29 is made of a steel plate, rigid resin plate or like rigid plate. The outer peripheral portion of the rigid pad 29 may have any shape provided that the disk sander 27 is thereby pressed into contact with the floor surface 2 only at its outer periphery portion. For example, the pad outer peripheral portion can be horizontal and flat, or of a bent form.

Figure 6:
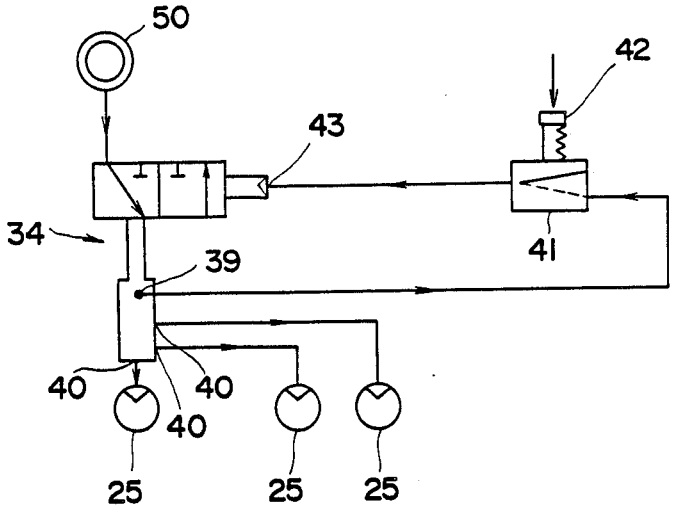
FIG. 6 is a diagram showing the pneumatic circuit of the apparatus.

As seen in FIG. 6, each pneumatic drive motor 25 is connected to an air supply source via a pilot valve 34.

Figure 7:
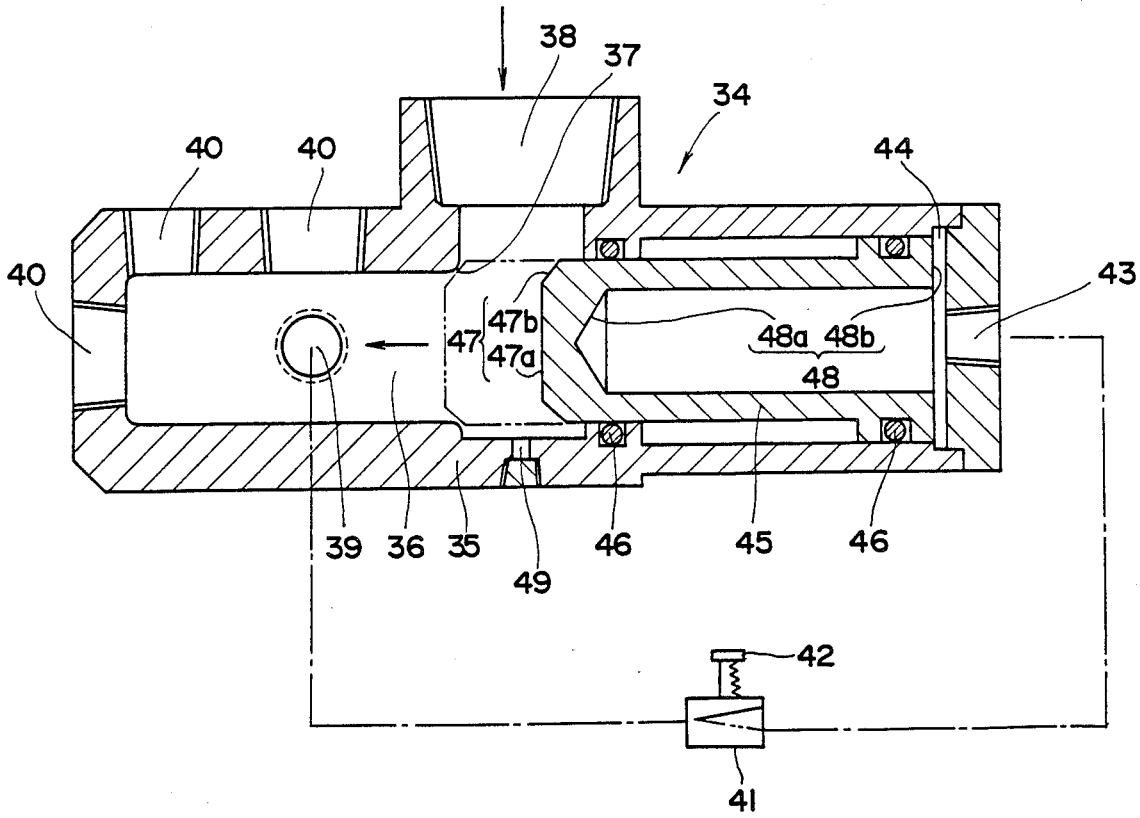
FIG. 7 is a sectional view showing a pilot valve included in the apparatus.

With reference to FIG. 7, the pilot valve 34 has a valve casing 35 formed with an L-shaped flow channel 36. A valve seat 37 is formed at the bent portion of the flow channel 36. The valve casing 35 has an inlet 38 communicating with the flow channel 36 at a location upstream from the valve seat 37 and with the air supply source 50. At a location downstream from the valve seat 37, the flow channel 36 communicates with a control outlet 39 and with supply outlets 40 each communicating with the corresponding pneumatic drive motor 25. The control outlet 39 communicates with a control inlet 43 formed in the valve casing 35 via a change-over valve 41 provided with an operating member 42. The control inlet 43 is in communication with a plunger chamber 44 formed in the valve casing 35 and positioned adjacent the flow channel 36. A plunger 45 having O-rings 46 therearound is enclosed in and guidable by the plunger chamber 44. The plunger 45 is movable into and out of contact with the valve seat 37 and has a front pressure receiving surface 47 and a rear pressure receiving surface 48. The front pressure receiving surface 47 comprises a planar central portion **47*a* and a tapered peripheral portion 47*b* therearound. The tapered peripheral portion 47*b* is adapted for substantial line contact with the valve seat 37 and is subjected to the pressure of air upstream from the valve seat 37 at all times. The rear pressure receiving surface 48 also comprises two portions 48*a* and 48*b* and is larger than the front pressure receiving surface 47 in effective pressure receiving area. The change-over valve 41 is a normally closed valve having a locking function and is mounted on a front portion of the truck 1. The operating member 42 of the valve 41 projects from the front portion of the truck 1 (FIG. 1). Indicated at 49** is a drain opening.

Figure 8:
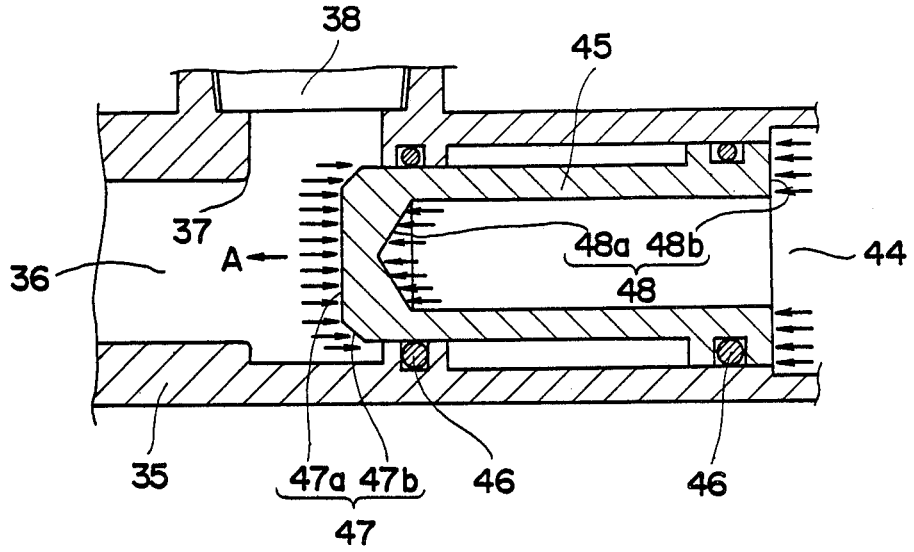
FIGS. 8 and 9 are sectional views showing the pilot valve in an open position and a closed position, respectively, for illustrating the operating principle of the valve.

The pilot valve 34 of the above construction operates in the following manner. The pilot valve 34 is usually in an open state indicated in solid lines in FIG. 7 to supply pressurized air to the pneumatic drive motors 25 from the air supply source 50, whereby the abrasive cleaning tools 13 are rotated. At this time, the drive motor 7 for the rear wheels 6 is in operation to move the truck 1 on the floor 2 along the longitudinal member 10 and continuously clean the floor surface 2 by abrasion. When the truck 1 approaches, for example, a transverse member (not shown) of the ship during travel, the operating member 42 of the change-over valve 41 mounted on the front portion of the truck 1 is pushed in and locked, whereby the valve 41 is changed from the normally closed state to an open state. This delivers the pressure within the flow channel 36 into the plunger chamber 44 via the control outlet 39, the open change-over valve 41 and the control inlet 43. Since the rear pressure receiving surface 48 of the plunger 45 is larger than the front pressure receiving surface 47 in effective pressure receiving area, the plunger 45 moves in the direction of arrow A in FIG. 8 to close the pilot valve 34. This consequently stops the supply of air to the pneumatic drive motors 25, i.e., the abrasive cleaning operation. At the same time, the drive motor 7 for the rear wheels 6 is also stopped.

Figure 9:
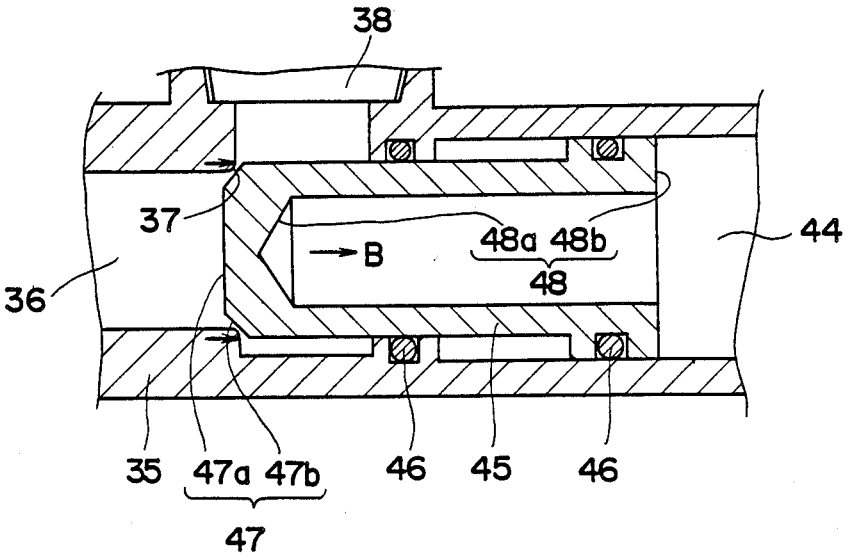

When the preparation for subsequent cleaning operation has been made, the change-over valve 41 is unlocked, whereupon the valve 41 is returned to the normally closed state again, releiving the plunger chamber 44 of the pressure. Consequently the plunger 45 is subjected to the pressure within the flow channel 36 at the tapered outer peripheral portion 47*b* of its front pressure receiving surface 47 as shown in FIG. 9. The plunger 45 therefore moves in the direction of arrow B overcoming the frictional force between the plunger 45 and the O-rings 46 to open the pilot valve 34. This supplies pressurized air from the air supply source 50 to the pneumatic drive motors 25 to rotate the tools 13 and resume the cleaning operation.

The pilot valve 34 having the construction and function described above is much more advantageous than known pilot valves. The pilot valve 34 of the present invention can be opened and closed only by the pressure acting on the plunger 45 without necessitating a diaphragm or like additional member for opening and closing unlike the known ones. Furthermore, the pilot valve 34 of the present invention also has the function of an air distributor for the plurality of pneumatic drive motors 25. The present valve is accordingly smaller in weight than the conventional one which is connected to a separate air distributor.

Although the illustrated pilot valve 34 is provided with only three supply outlets 40 communicating with the pneumatic drive motors 25 for the abrasive cleaning tools 13, the valve may of course be formed with a fourth supply outlet for communication with the drive motor 7 which is designed as the pneumatic type for the rear wheels 6.

What is claimed is:

1. An apparatus for abrasive cleaning comprising a truck adapted to run on the surface to be cleaned and at least one abrasive cleaner supported by supporting means on the truck and limitedly movable toward or away from the surface, the abrasive cleaner having an abrasive cleaning tool at its lower end, said or each abrasive cleaner being supported by the supporting means so as to be limitedly tiltable in every direction with respect to an axis approximately perpendicular to the surface, the supporting means being provided with resilient means for biasing the abrasive cleaner away from the surface, said or each abrasive cleaner being provided with a fluid drive motor for rotating the abrasive cleaning tool, the drive motor being connected to a working fluid supply source by way of a pilot valve openable or closable by a change-over valve, the pilot valve having a vlave casing, an L-shaped flow channel formed within the valve casing, a valve seat formed at an intermediate portion of the flow channel, a plunger enclosed in and guidable by a plunger chamber formed within the valve casing, the plunger being provided with first pressure receiving surface means positioned within the flow channel in opposed relation to the valve seat and with second pressure receiving surface means positioned within the plunger chamber and having a larger effective pressure receiving area than the first pressure receiving surface means, an inlet formed in the valve casing and communicating with the flow channel at a location upstream from the valve seat and with the working fluid supply source, a control outlet formed in the valve casing and communicating with the flow channel at a location downstream from the valve seat, the control outlet being adapted to communicate with the plunger chamber through the change-over valve when the change-over valve is in its open state, and a supply outlet formed in the valve casing and communicating with the flow channel at a location downstream from the valve seat and with the fluid drive motor of said or each abrasive cleaner.

2. An apparatus as defined in claim 1 wherein said or each abrasive cleaner comprises a main body having a substantially cylindrical outer surface provided with an annular flange, and said supporting means comprises a holding cylinder surrounding the cleaner main body with a first gap formed therebetween, an upper ring and a lower ring attached to the upper and lower ends of the holding cylinder and surrounding the cleaner main body with a second gap smaller than the first gap formed therebetween, a compression spring serving as the resilient means and provided between the lower ring and the annular flange of the cleaner main body within the first gap, and a holding arm connecting the holding cylinder to the truck.

3. An apparatus as defined in claim 1 wherein said abrasive cleaning tool comprises a disk sander mounted on a drive shaft projecting from the lower end of said abrasive cleaner, and the disk sander is pressed into contact with the surface to be cleaned only at its outer peripheral portion by pressing means attached to the drive shaft.

4. An apparatus as defined in claim 3 wherein the pressing means comprises a dish-like rigid pad slightly smaller than the disk sander in outside diameter.

5. An apparatus as defined in claim 4 wherein an annular washer is interposed between the central portion of the disk sander and the central portion of the rigid pad, and the central portion of the disk sander is held in pressing contact with the washer by a fastening member.

6. An apparatus as defined in claim 1 wherein the first pressure recieving means of the plunger is adapted to be partly subjected to the pressure of a fluid upstream from the valve seat when the plunger comes into contact with the valve seat.

7. An apparatus as defined in claim 6 wherein the first pressure receiving surface means of the plunger has a planar central portion and a tapered peripheral portion adapted for substantial line contact with the valve seat.

8. An apparatus as defined in claim 1 wherein the change-over valve comprises a normally closed valve having a locking function and provided with an operating member projecting from the front end of the truck, and the change-over valve is opened by the operating member being pushed in during travel of the truck by a collision surface upstanding from the surface to be cleaned to discontinue the supply of working fluid to the fluid drive motor of said or each abrasive cleaner by way of the pilot valve.

9. An apparatus as defined in claim 1 wherein a pair of telescopic arms extending approximately in parallel with the surface to be cleaned is fixed to the truck at one end of each arm, and a roller is rotably mounted on the other end of each telescopic arm, the truck being adapted to run at a predetermined distance away from a guide surface extending upright from the surface to be cleaned by holding the rollers in contact with the guide surface.

10. An apparatus as defined in claim 2 wherein bellows are provided between said or each abrasive cleaner and the upper ring.

* * * * *